US009108302B1

(12) United States Patent
Ritchie

(10) Patent No.: US 9,108,302 B1
(45) Date of Patent: Aug. 18, 2015

(54) INTERCHANGEABLE HEAD WRENCH ASSEMBLY

(76) Inventor: John H. Ritchie, Anchorage, AK (US)

( * ) Notice: Subject to any disclaimer, the term of this patent is extended or adjusted under 35 U.S.C. 154(b) by 482 days.

(21) Appl. No.: 13/467,030

(22) Filed: May 8, 2012

(51) Int. Cl.
*B25B 13/58* (2006.01)
*B25B 7/04* (2006.01)
*B25B 13/12* (2006.01)

(52) U.S. Cl.
CPC .. *B25B 7/04* (2013.01); *B25B 13/12* (2013.01)

(58) Field of Classification Search
CPC ..... B25B 7/04; B25B 13/12; B25B 13/5058; B25B 23/00; B25B 13/08; B25B 13/48; B25B 13/5091; B25B 13/06; B25B 13/04; E21B 17/046; F16B 21/18; F16D 1/116
USPC ..... 81/180.1, 185.1, 185.2, 180, 185, 81/124.3, 124.2
See application file for complete search history.

(56) References Cited

U.S. PATENT DOCUMENTS 1,472,517 A * 10/1923 Fry ..... 81/120
3,858,464 A 1/1975 Evans
4,016,782 A 4/1977 Guimarin
4,562,757 A 1/1986 Furey
5,062,327 A 11/1991 Hammons et al.
5,257,556 A * 11/1993 Pineault ..... 81/124.2
D376,521 S 12/1996 Farnan et al.
5,768,961 A 6/1998 Frawley
6,490,953 B2 12/2002 Horvath
2002/0178872 A1* 12/2002 Ferrantelli ..... 81/124.3
2008/0022814 A1* 1/2008 Chiang ..... 81/177.8
2011/0167965 A1* 7/2011 Fielding ..... 81/124.2
2011/0232428 A1* 9/2011 Lanfear et al. ..... 81/185.2

* cited by examiner

*Primary Examiner* — Monica Carter
*Assistant Examiner* — Melanie Alexander

(57) ABSTRACT

An interchangeable head wrench assembly is provided for securing a selectable engagement head to a handle to facilitate turning or twisting an object or holding an object in place. The assembly includes a handle having an elongated gripping section and a head engagement section coupled to and extending from the gripping section. An aperture extends through the head engagement section. A plurality of interchangeable attachment heads are provided each having a seat portion complimentary to the aperture extending through the head engagement section of the handle. The seat portion is insertable into the aperture whereby each attachment head is restricted from twisting within the aperture and may be used to perform a desired task.

18 Claims, 10 Drawing Sheets

FIG. 3
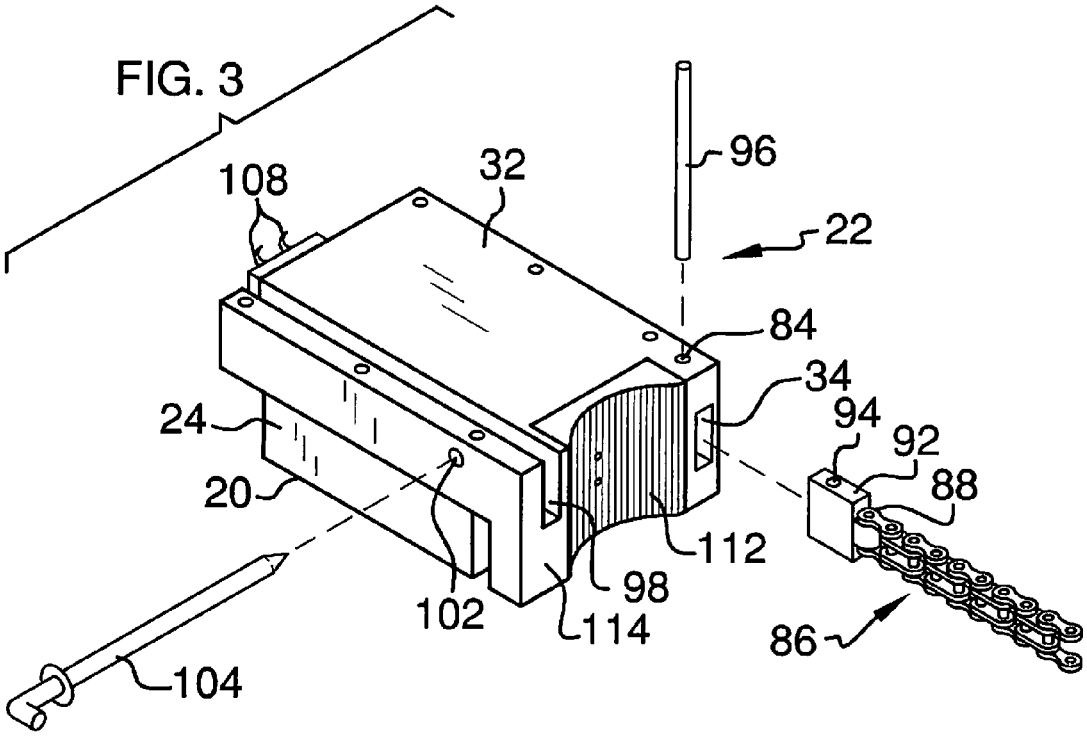
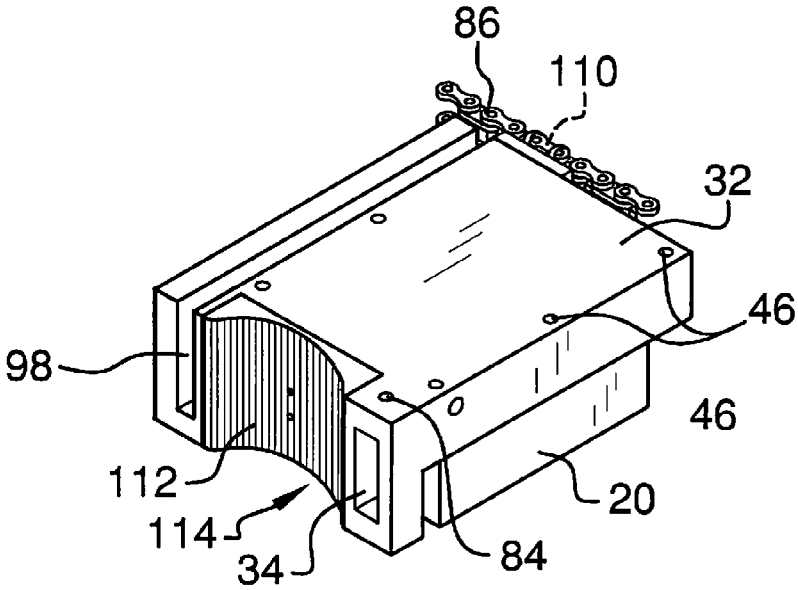
FIG. 4

INTERCHANGEABLE HEAD WRENCH ASSEMBLY

BACKGROUND OF THE DISCLOSURE

Field of the Disclosure

The disclosure relates to wrench devices and more particularly pertains to a new wrench device for securing a selectable engagement head to a handle to facilitate turning or twisting an object or holding an object in place.

SUMMARY OF THE DISCLOSURE

An embodiment of the disclosure meets the needs presented above by generally comprising a handle having an elongated gripping section and a head engagement section coupled to and extending from the gripping section. An aperture extends through the head engagement section. A plurality of interchangeable attachment heads are provided each having a seat portion complimentary to the aperture extending through the head engagement section of the handle. The seat portion is insertable into the aperture whereby each attachment head is restricted from twisting within the aperture and may be used to perform a desired task.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 3 is a partially exploded top front side perspective view of an attachment head of an embodiment of the disclosure.

FIG. 4 is a top front side perspective view of an attachment head of an embodiment of the disclosure.

DESCRIPTION OF THE PREFERRED EMBODIMENT

Figure 1:
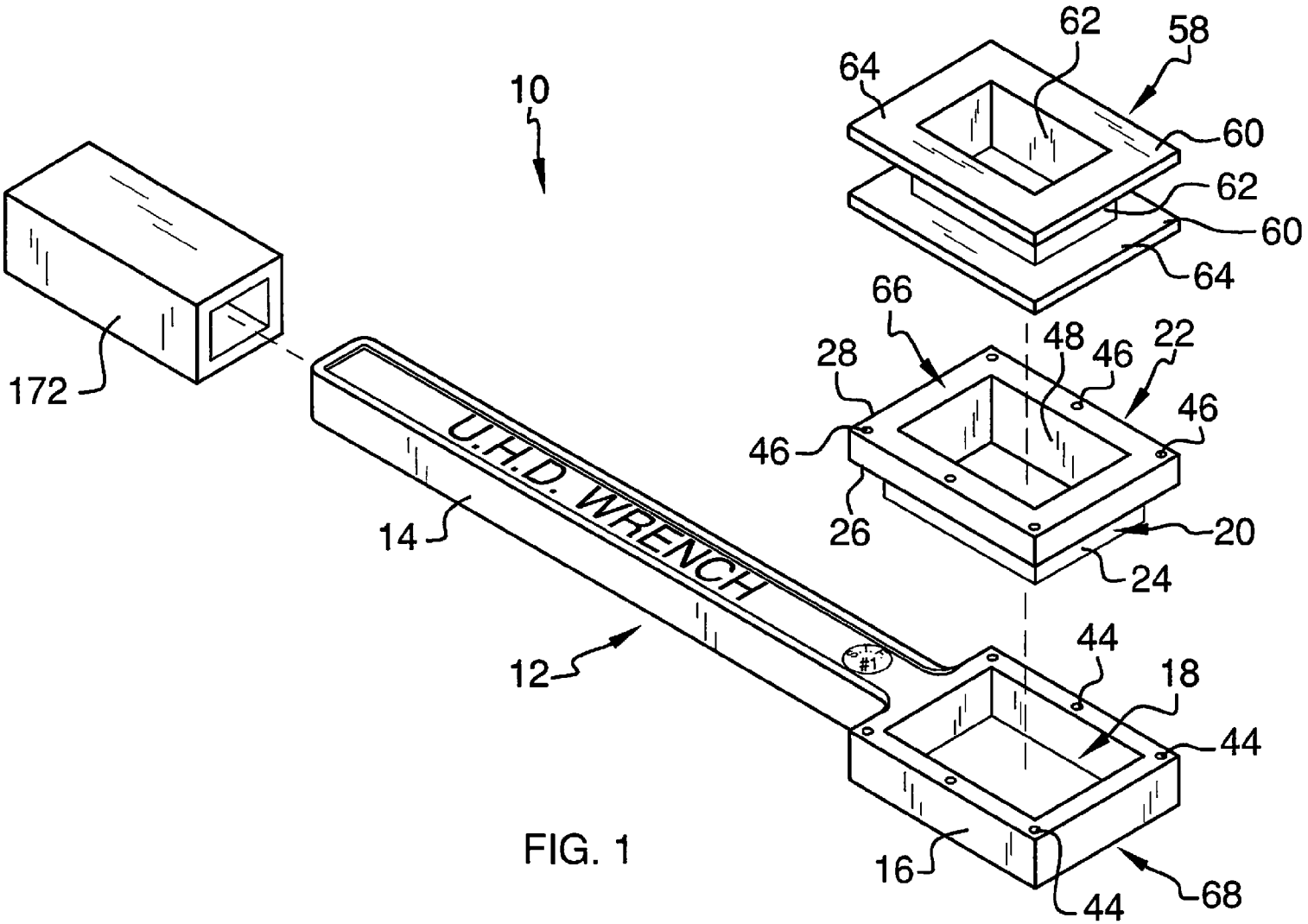
FIG. 1 is a partially exploded top front side perspective view of a interchangeable head wrench assembly according to an embodiment of the disclosure.

With reference now to the drawings, and in particular to FIGS. 1 through 13 thereof, a new wrench device embodying the principles and concepts of an embodiment of the disclosure and generally designated by the reference numeral 10 will be described.

As best illustrated in FIGS. 1 through 13, the interchangeable head wrench assembly 10 generally comprises a handle 12 having an elongated gripping section 14 and a head engagement section 16 coupled to and extending from the gripping section 14. An aperture 18 extends through the head engagement section 16. The aperture 18 may be irregularly shaped to prevent slippage of a seat portion 20 of an attachment head 22 within the aperture 18. Thus, the aperture 18 may be polygonal or more particularly rectangular. A plurality of selectable and interchangeable attachment heads 22 is provided. Each attachment head 22 has an associated seat portion 20. The seat portion 20 of each attachment head 22 has a perimeter edge 24 complimentary to the aperture 18 extending through the head engagement section 16 of the handle 12. Thus, the seat portion 20 is insertable into the aperture 18 whereby the attachment head 22 is restricted from twisting within the aperture 18. Each attachment head 22 may further have a lip 26 extending outwardly around the seat portion 20. The plurality of attachment heads 22 includes a yoke engagement head 28, a bar insert attachment head 30, a chain wrench attachment head 32 having a chain attachment socket 34, a strap wrench attachment head 36 having a strap attachment socket 38, a socket attachment head 40, and a pipe wrench attachment head 42. Each attachment head 22 is described more fully below.

A plurality of holes 44 may extend through the head engagement section 16 of the handle 12 proximate the aperture 18. A plurality of openings 46 extend through the lip 26 of each attachment head 22. The openings 46 are aligned with the holes 44 when the seat portion 20 is inserted into the aperture 18. Thus, each attachment head 22 may be secured to the head engagement section 16 if so desired. The holes 44 are threaded to permit attachment of each attachment head 22 by use of screws to prevent disengagement of the attachment head 22 from the head engagement section 16. Thus, the attachment head 22 may engage an object from either side of the attachment head, where possible, without being disengaged from the head engagement section 16.

Figure 9:
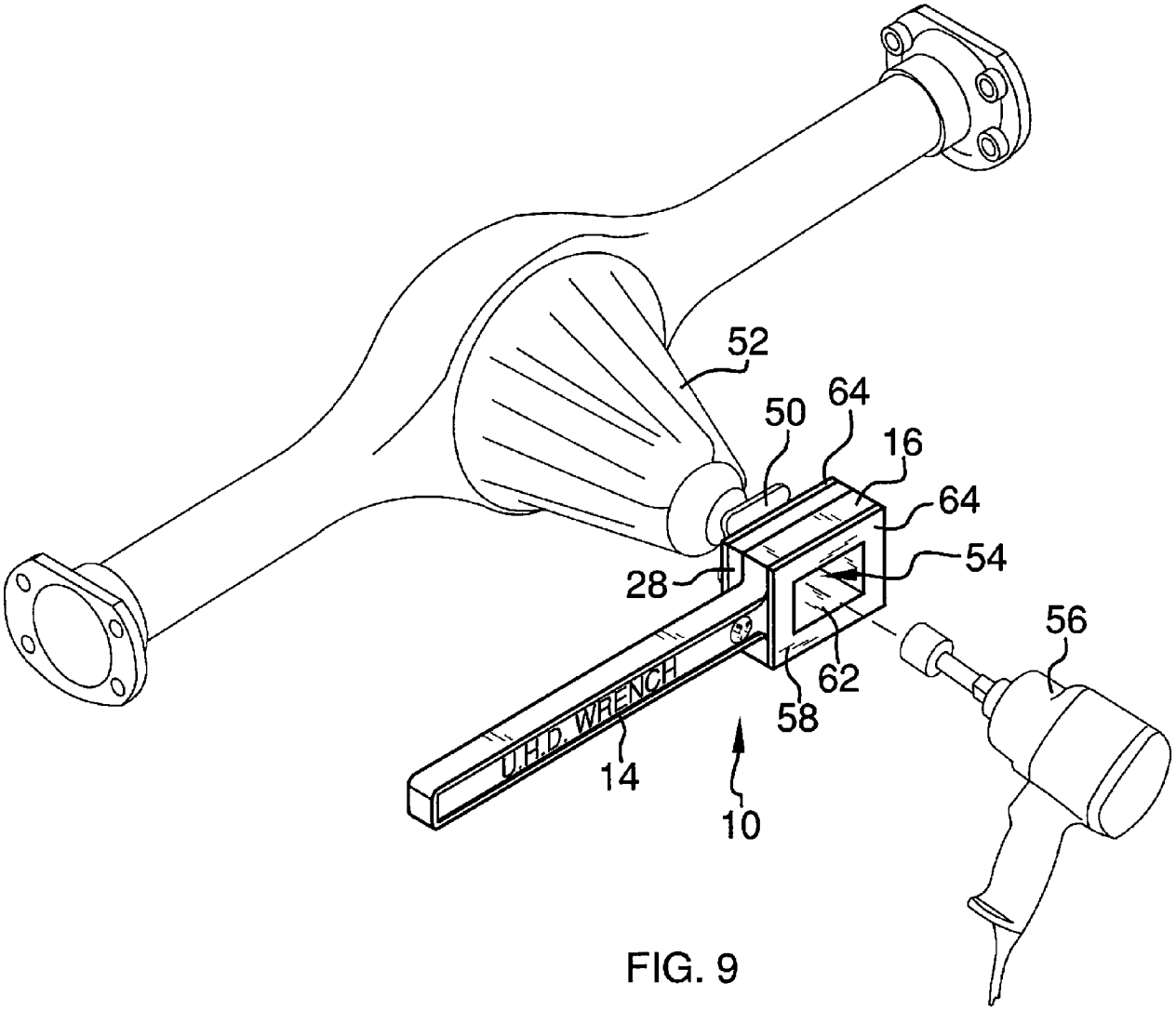
FIG. 9 is a bottom front side perspective view of an embodiment of the disclosure in use.

In reference to the yoke engagement head 28 shown in FIGS. 1 and 9, an interior wall 48 of the yoke attachment head 28 extends through the seat portion 20. The interior wall 48 is configured for receiving and engaging a yoke 50 as may associated with a vehicle differential 52. Thus, holding the handle 12 in a static position prevents rotation of the yoke 50 while an adjacent part 54 may be engaged by a driving tool 56. A liner insert 58 may be coupled to the yoke engagement head 28 if desired. The liner insert 58 has a pair of spaced panels 60 and a medial wall 62 extending between the spaced panels 60. The medial wall 62 is configured for positioning between the interior wall 48 of the yoke attachment head 28 and the yoke 50. The spaced panels 60 are parallel to each other and extend outwardly from the medial wall 62 whereby peripheral portions 64 of the spaced panels 60 cover an outer face 66 of the yoke attachment head 28 and an outer face 68 of the head engagement section 16 of the handle 12.

Figure 2:
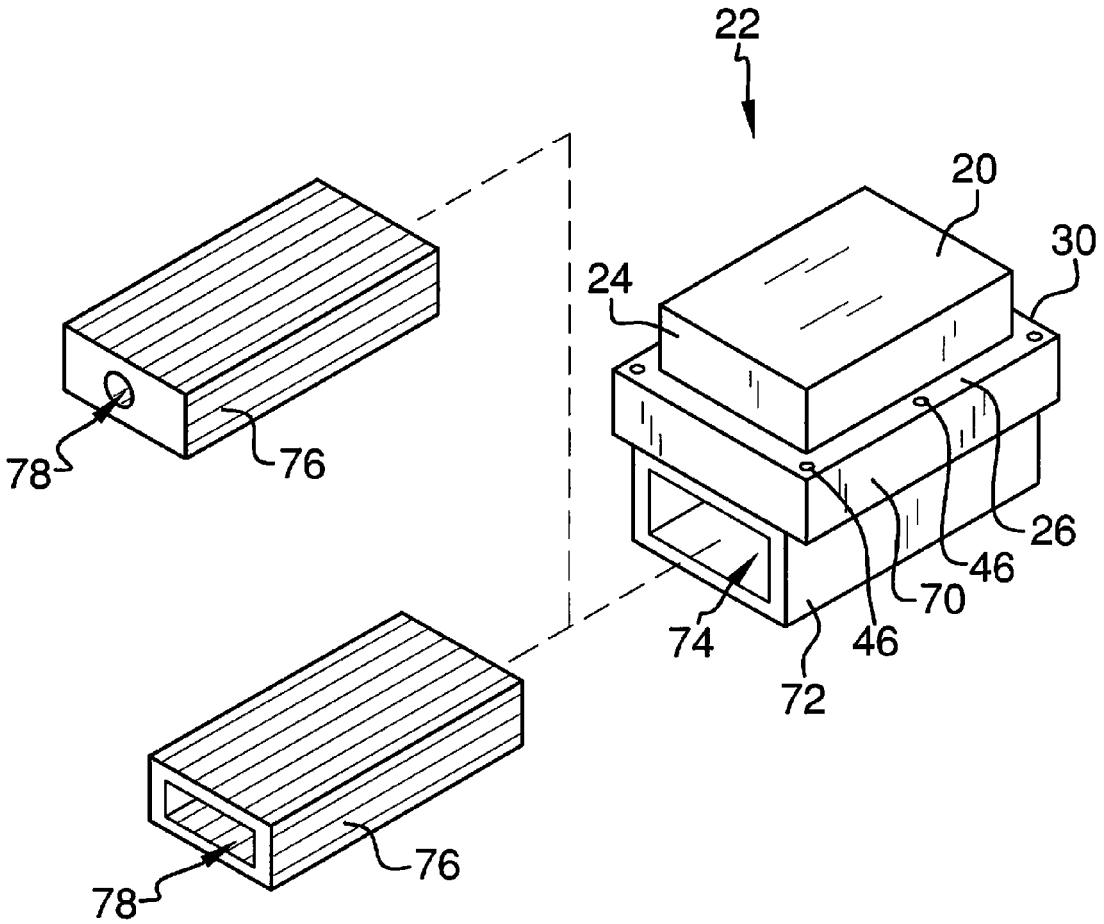
FIG. 2 is a partially exploded top front side perspective view of an attachment of an embodiment of the disclosure.
Figure 5:
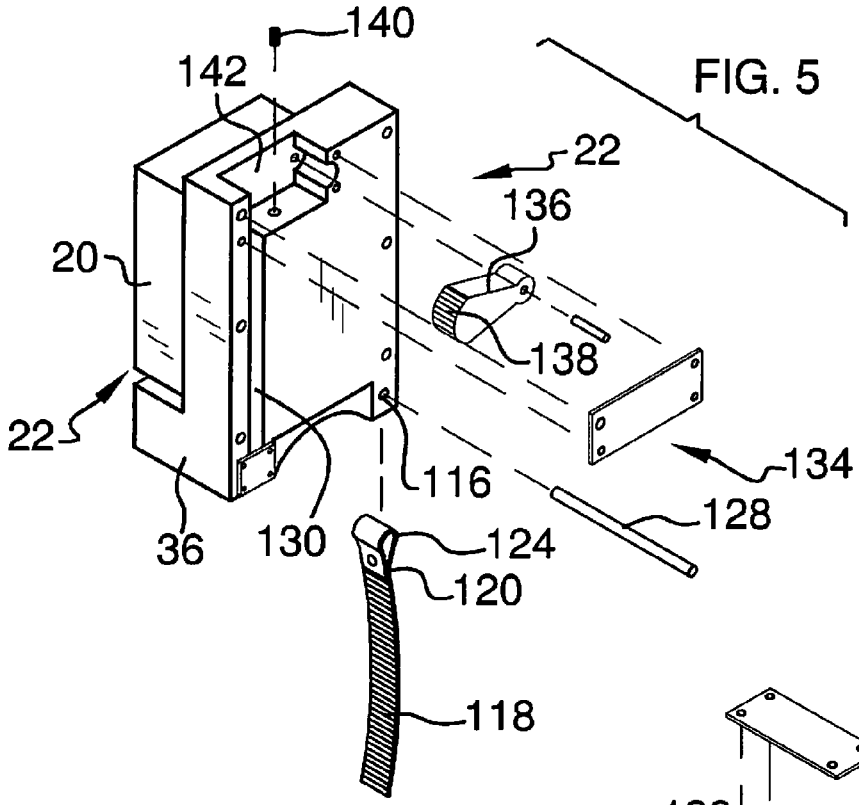
FIG. 5 is a partially exploded bottom front side perspective view of an attachment head of an embodiment of the disclosure.
Figure 6:
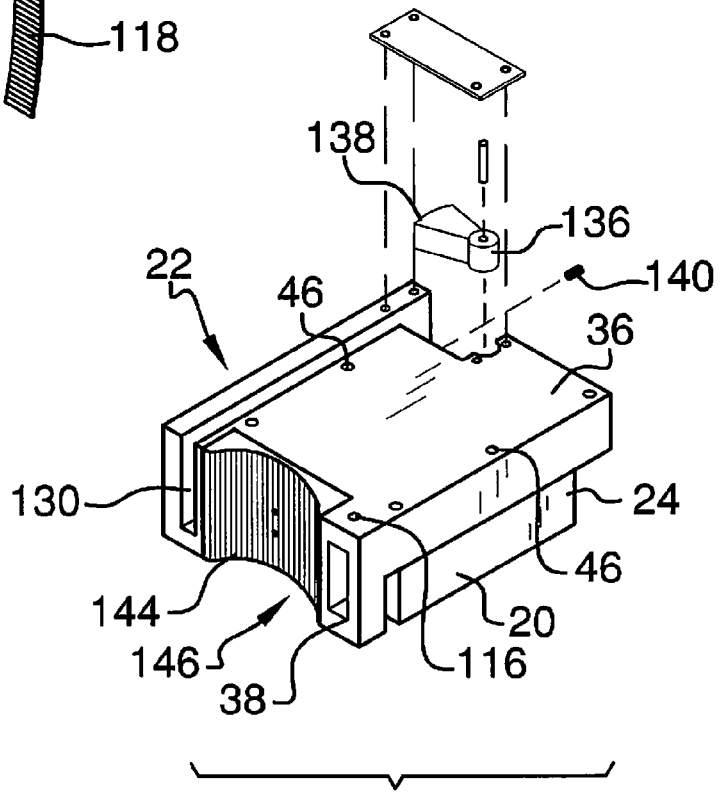
FIG. 6 is a partially exploded top front side perspective view of an attachment head of an embodiment of the disclosure.
Figure 10:
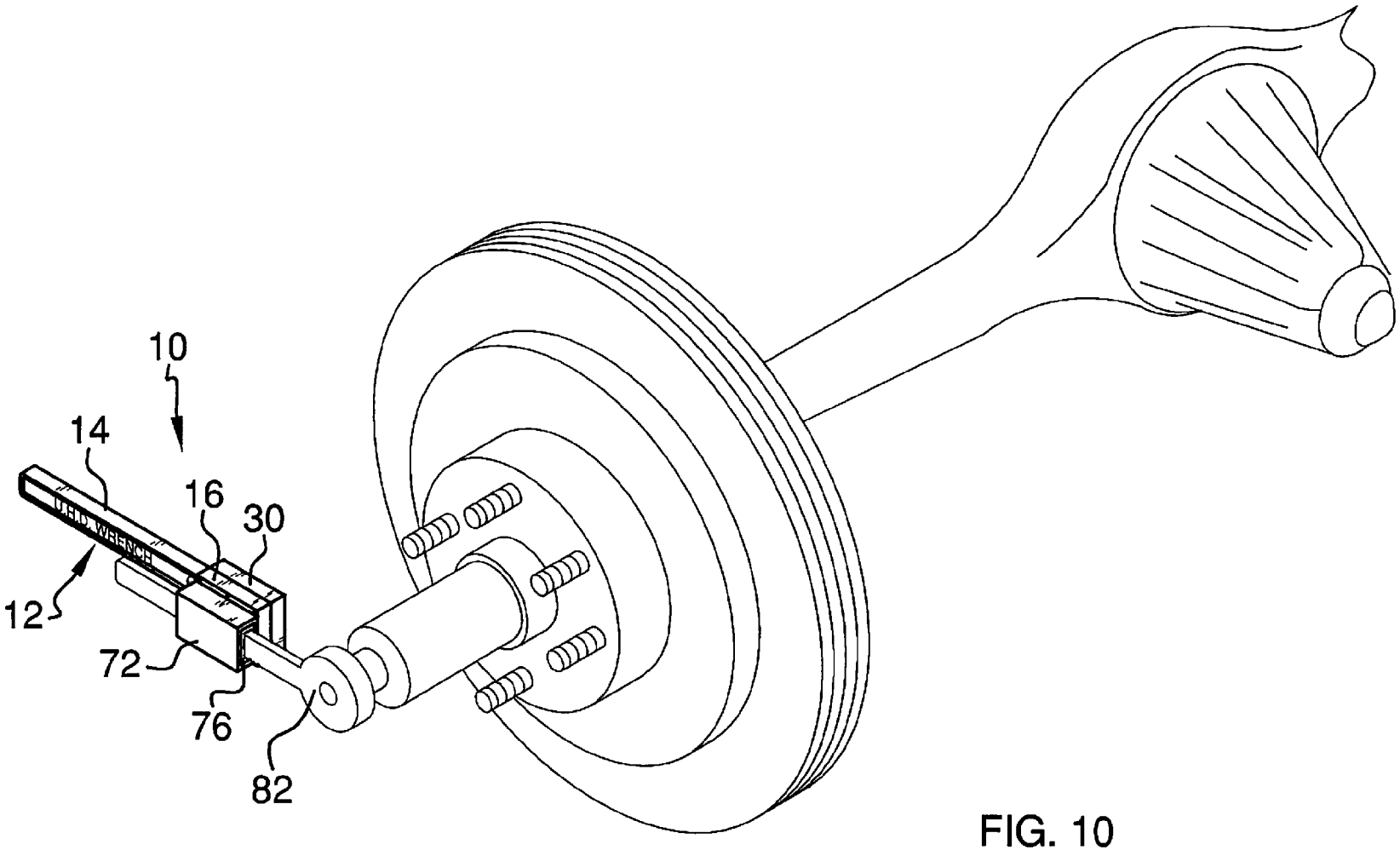
FIG. 10 is a top front side perspective view of an embodiment of the disclosure in use.

In reference to the bar insert attachment head 30 as shown in FIGS. 2 and 10, a central portion 70 of the bar insert attachment head 30 is coupled to and extends from the seat portion 20. The bar insert attachment head 30 has a receiving portion 72 coupled to the central portion 70. The receiving portion 72 has an elongated passage 74 extending through the receiving portion 72. The passage 74 may be oriented parallel to the gripping portion 14 of the handle 12 when the bar insert attachment head 30 is coupled to the handle 12. A sleeve 76 is insertable into the passage 74 of the bar insert attachment head 30. The sleeve 76 has a channel 78 extending therethrough configured for receiving an elongated member 80 such as an elongated driving tool 82. Manipulation of the handle 12 acts on the elongated member 80 providing enhanced leverage or torque when desired.

Figure 11:
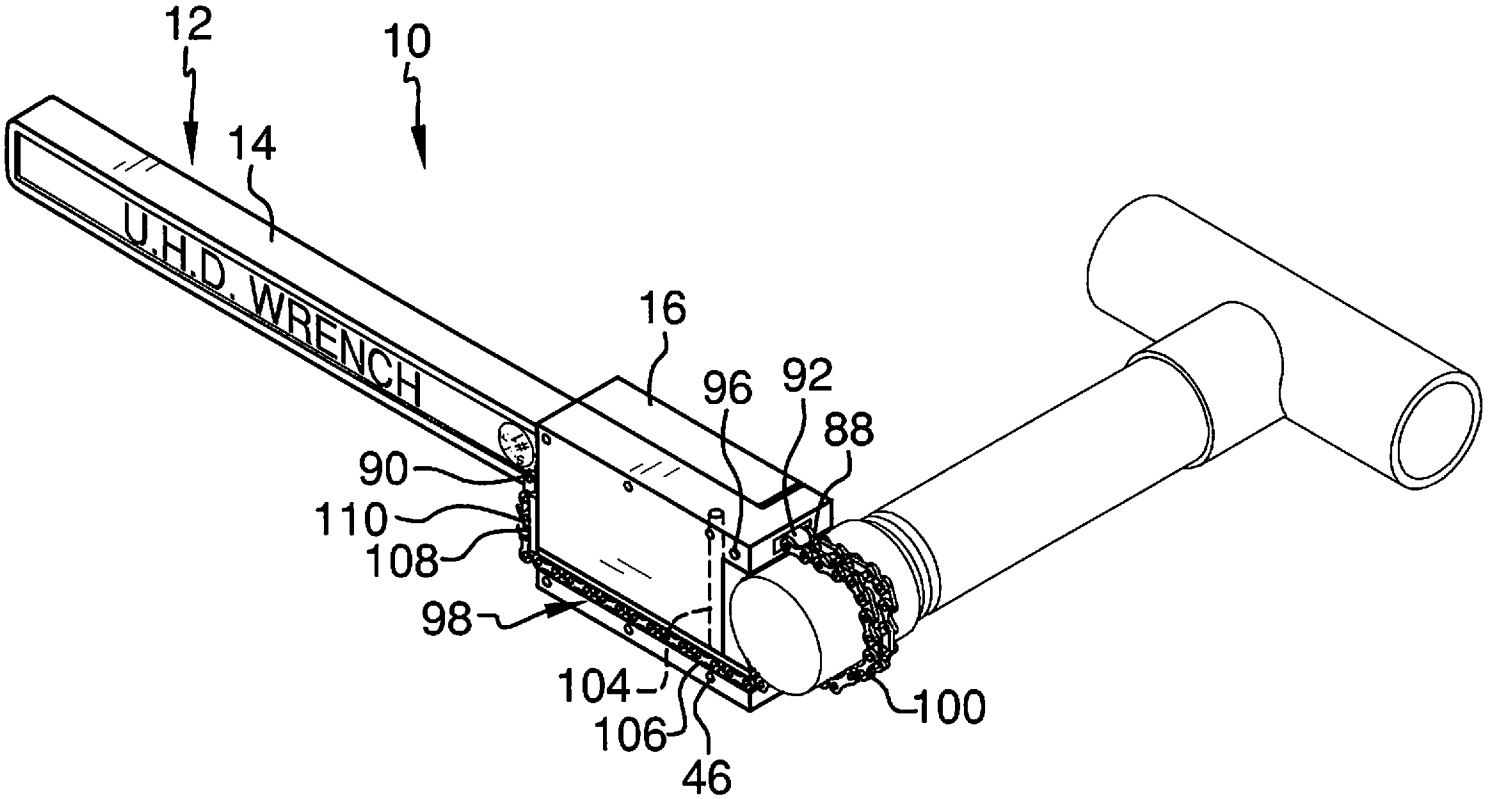
FIG. 11 is a top front side perspective view of an embodiment of the disclosure in use.
Figure 12:
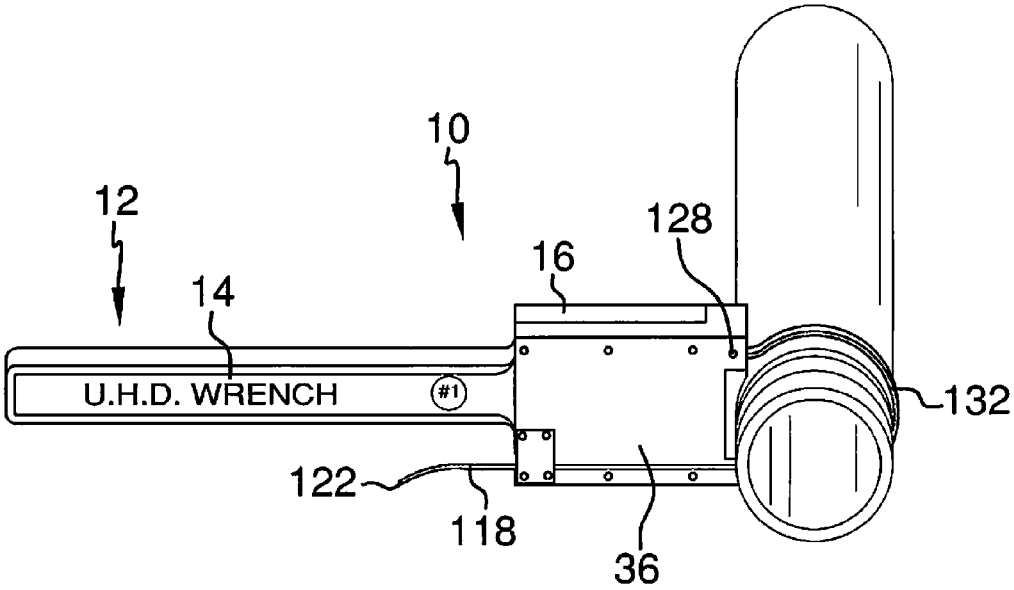
FIG. 12 is a front side perspective view of an embodiment of the disclosure in use.
Figure 13:
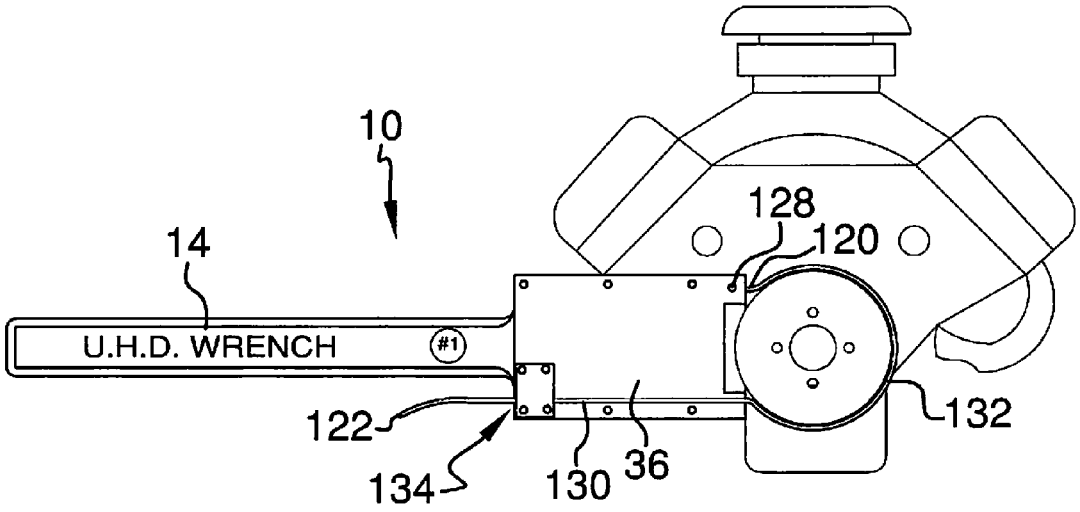
FIG. 13 is a front view of an embodiment of the disclosure in use.

In reference to the chain wrench attachment head 32 shown in FIGS. 3, 4, and 11, a chain end aperture 84 extends through the chain wrench attachment head 32 into the chain attachment socket 34. A chain 86 has a first end 88 and a second end 90. A connection member 92 is coupled to the first end 88 of the chain 86. The connection member 92 is insertable into the chain attachment socket 34. The connection member 92 has a connection hole 94 aligning with the chain end aperture 84 when the connection member 92 is inserted into the chain connection socket 34. A chain end pin 96 may be inserted through the chain connection aperture 84 engaging the connection hole 94 whereby the first end 88 of the chain 86 is coupled to the chain wrench attachment head 32. A chain channel 98 may extend through the chain wrench attachment head 32. A medial portion 100 of the chain 86 is positionable in the chain channel 98. A chain link aperture 102 extends through the chain wrench attachment head 32 into the chain channel 98. A chain link pin 104 may be inserted through the chain link aperture 102 into the chain channel 98 engaging a link 106 of the chain 86 whereby the chain 86 is held in a static position in the chain channel 98. Alternately, or in combination with the above, a hook 108 or plurality of hooks 108 may be coupled to and extend from the chain wrench attachment head 32. The hook 108 engages a link 110 of the chain 86. An angled indentation 112 may be provided extending into a side 114 of the chain wrench attachment head 32. The indentation 112 may be positioned proximate the chain end aperture 84. The indentation 112 may also be incorporated into an insert 174 coupled to the chain wrench attachment head 32.

In reference to the strap wrench attachment head 36 shown in FIGS. 5, 6, 12, and 13, a strap end aperture 116 extends through the strap wrench attachment head 36 into the strap attachment socket 38. A strap 118 is provided having a first end 120 and a second end 122. A loop 124 is coupled to or formed in the first end 120 of the strap 118. The loop 124 is insertable into the strap attachment socket 38 aligning with the strap end aperture 116 when the loop 124 is inserted into the strap connection socket 38. A strap end pin 128 is inserted through the strap end aperture 116 engaging the loop 124 whereby the first end 120 of the strap 118 is coupled to the strap wrench attachment head 36. A strap channel 130 extends through the strap wrench attachment head 36. A medial portion 132 of the strap 118 is positionable in the strap channel 130. A strap pressure lock assembly 134 is coupled to the strap wrench attachment head 36. The strap pressure lock assembly 134 includes a pivotable friction member 136 having an end 138 extending into the strap channel 130 and selectively engaging the strap 118. The strap pressure lock assembly 134 includes a biasing member 140 for urging the friction member 138 into engagement with the strap 118. The strap pressure lock assembly 134 is positioned in a cutout 142 in the strap wrench attachment head 36. An angled indentation 144 may extend into a side 146 of the strap wrench attachment head 36 proximate the strap end aperture 116. The indentation 144 may also be incorporated into an insert 176 coupled to the strap wrench attachment head 36.

Figure 7:
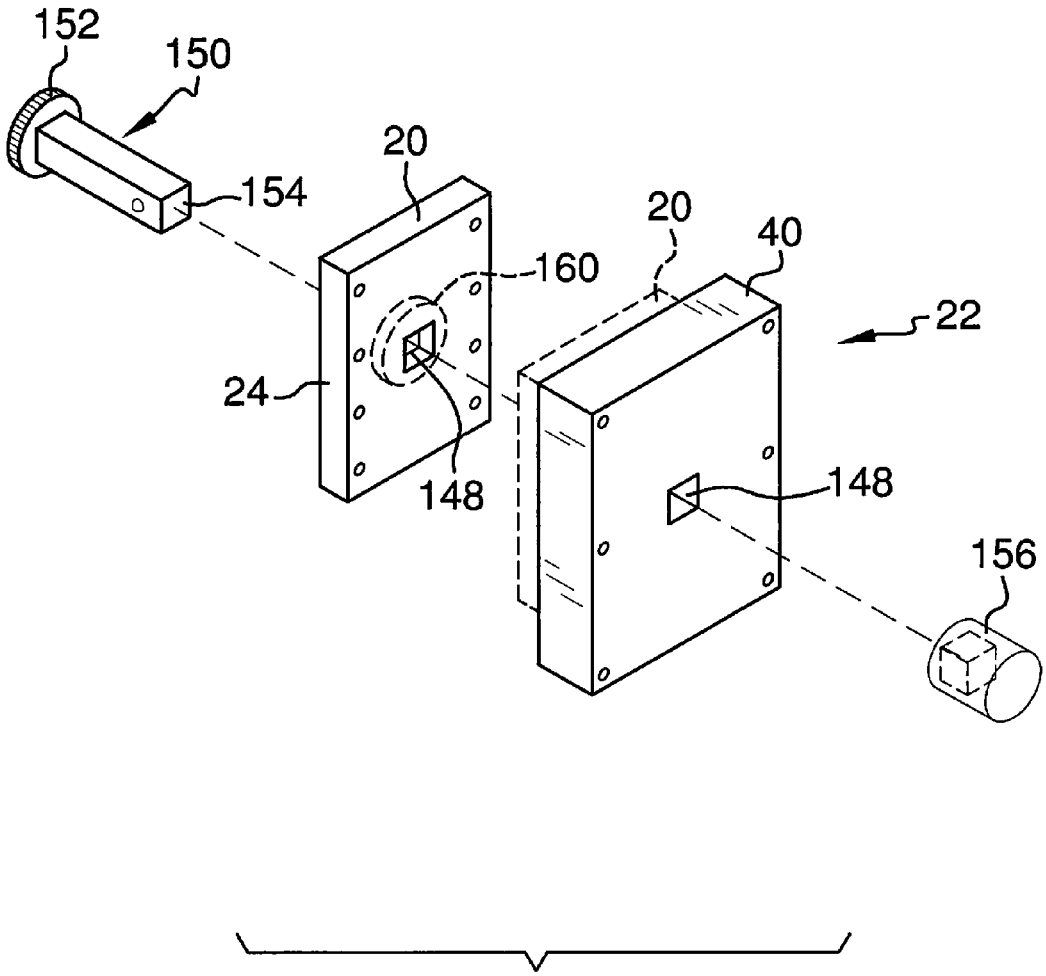
FIG. 7 is a partially exploded top front side perspective view of an attachment head of an embodiment of the disclosure.

In reference to the socket attachment head 40 shown in FIG. 7, a polygonal hole 148 extends through the socket attachment head 40. The polygonal hole 148 may be centrally positioned. A socket connector 150 is provided having a base 152 and a first end 154 opposite the base 152. The socket connector 150 is insertable through the polygonal hole 148 whereby the first end 154 of the socket connector 150 extends from the socket attachment head 40. The first end 154 is conventionally sized and configured for coupling to a preexisting socket 156. The base 152 may be inset into a cutout 160 extending into the socket attachment head 40.

Figure 8:
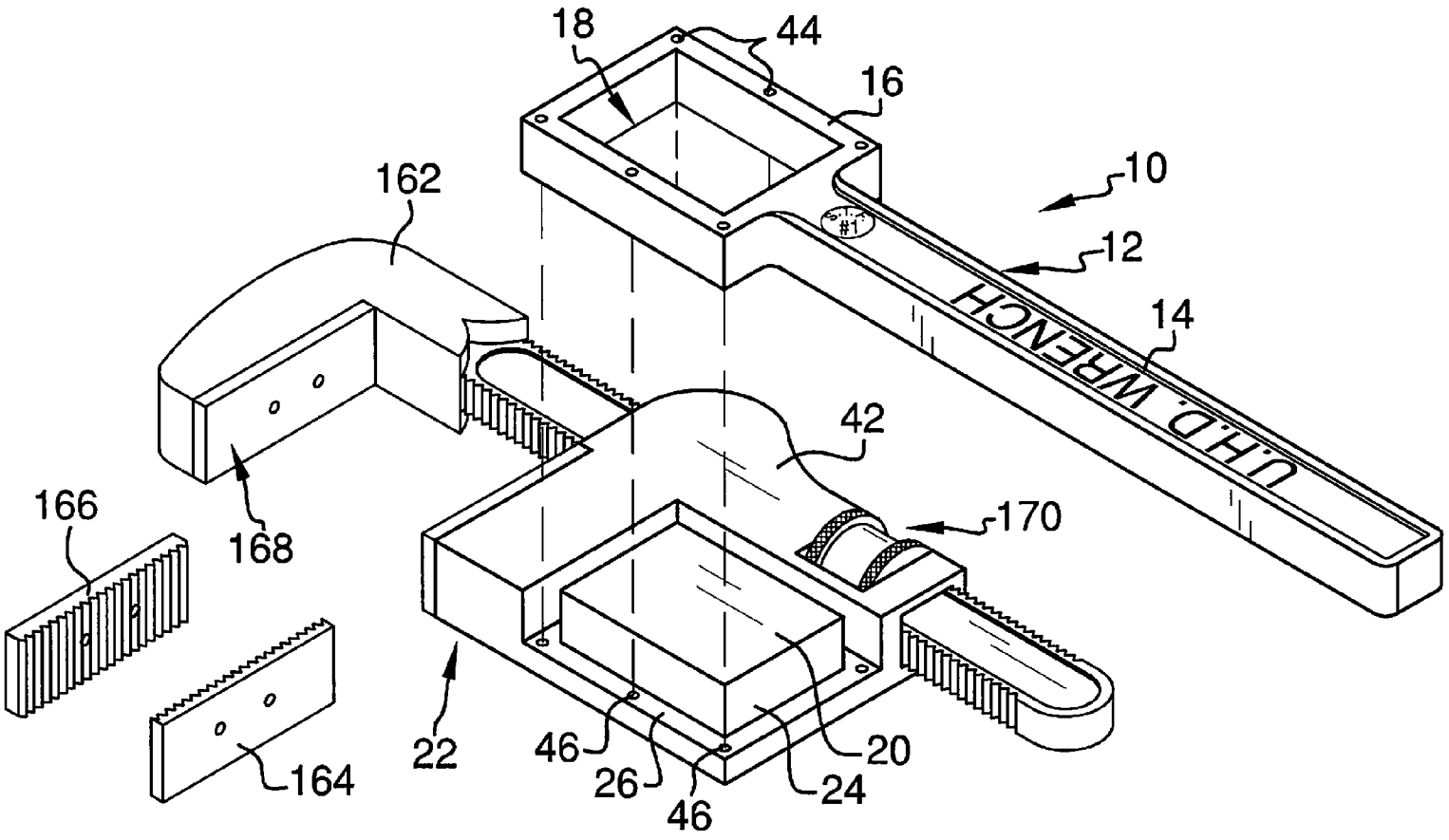
FIG. 8 is a partially exploded bottom front side perspective view of an embodiment of the disclosure.

In reference to the pipe wrench attachment head 42 as shown in FIG. 8, an arm 162 is extendably coupled to the pipe wrench attachment head 42. A static jaw plate 164 is coupled to the pipe wrench attachment head 42. An adjustable jaw plate 166 is coupled to a distal end 168 of the arm 162 relative to the pipe wrench attachment head 42. The adjustable jaw plate 166 is positioned in opposition to the static jaw plate 164. An adjustment assembly 170 is operationally coupled to the pipe wrench attachment head 42 and the arm 162 whereby the arm 162 is extendable to adjust a distance between the adjustable jaw plate 166 and the static jaw plate 164.

Optionally, a tubular grip sleeve 172 may be provided. The gripping section 14 of the handle 12 is insertable into the grip sleeve 172. The grip sleeve 172 may incorporate cushioning or a tacky outer surface or various shapes as may be desired. Thus, the grip sleeve 172 is coupled to the gripping section 14 of the handle 12 to provide or enhance a desired characteristic to the gripping section 14.

In use, a single handle 12 may be employed with a selectable one of the attachment heads 22 to perform a multitude of tasks.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An interchangeable head wrench assembly comprising:

a handle having an elongated gripping section and a head engagement section coupled to and extending from said gripping section, an aperture extending through said head engagement section; and a plurality of interchangeable attachment heads, each attachment head having a seat portion, said seat portion having a perimeter edge complimentary to said aperture extending through said head engagement section of said handle such that said seat portion is insertable into said aperture whereby said attachment head is restricted from twisting within said aperture, said plurality of attachment heads including a yoke engagement head, said yoke attachment head having an interior wall extending through said seat portion, said interior wall being configured for receiving and engaging a yoke whereby holding said handle in a static position prevents rotation of the yoke; and a liner insert coupleable to said yoke engagement head, said liner insert having a pair of spaced panels and a medial wall extending between said spaced panels, said medial wall being configured for positioning between said interior wall of said yoke attachment head and the yoke, said spaced panels being parallel to each other and extending outwardly from said medial wall whereby peripheral portions of said spaced panels cover an outer face of said yoke attachment head and an outer face of said head engagement section of said handle.

2. The assembly of claim 1, further including said aperture extending through said head engagement section of said handle being polygonal.

3. The assembly of claim 2, further including said aperture extending through said head engagement section of said handle being rectangular.

4. The assembly of claim 1, further comprising:

a plurality of holes extending through said head engagement portion proximate said aperture; and each said attachment head having a lip extending outwardly around said seat portion; and a plurality of openings extending through said lip of each said attachment head, said openings being aligned with said holes when said seat portion is inserted into said aperture.

5. The assembly of claim 1, further including said plurality of attachment heads including a bar insert attachment head, said bar insert attachment head having a central portion coupled to and extending from said seat portion, said bar insert attachment head having a receiving portion coupled to said central portion, said receiving portion having an elongated passage extending through said receiving portion, said passage being oriented parallel to said gripping portion of said handle when said bar insert attachment head is coupled to said handle.

6. The assembly of claim 5, further including a sleeve insertable into said passage of said bar insert attachment head, said sleeve having a channel extending therethrough configured for receiving an elongated member whereby manipulation of said handle acts on the elongated member.

7. The assembly of claim 1, further comprising:

said plurality of attachment heads including a chain wrench attachment head, said chain wrench attachment head having a chain attachment socket;

a chain end aperture extending through said chain wrench attachment head into said chain attachment socket;

a chain having a first end and a second end;

a connection member coupled to said first end of said chain, said connection member being insertable into said chain attachment socket, said connection member having a connection hole, said connection hole aligning with said chain end aperture when said connection member is inserted into said chain connection socket; and a chain end pin inserted through said chain connection aperture engaging said connection hole whereby said first end of said chain is coupled to said chain wrench attachment head.

8. The assembly of claim 7, further comprising:

a chain channel extending through said chain wrench attachment head, a medial portion of said chain being positionable in said chain channel;

a chain link aperture extending through said chain wrench attachment head into said chain channel; and a chain link pin inserted through said chain link aperture into said chain channel engaging a link of said chain whereby said chain is held in a static position in said chain channel.

9. The assembly of claim 7, further including a hook coupled to and extending from said chain wrench attachment head, said hook engaging a link of said chain.

10. The assembly of claim 7, further including an angled indentation into a side of said chain wrench attachment head, said indentation being positioned proximate said chain end aperture.

11. The assembly of claim 1, further comprising:

said plurality of attachment heads including a strap wrench attachment head, said strap wrench attachment head having a strap attachment socket;

a strap end aperture extending through said strap wrench attachment head into said strap attachment socket;

a strap having a first end and a second end;

a loop coupled to said first end of said strap, said loop being insertable into said strap attachment socket, said loop aligning with said strap end aperture when said loop is inserted into said strap connection socket; and a strap end pin inserted through said strap end aperture engaging said loop whereby said first end of said strap is coupled to said strap wrench attachment head.

12. The assembly of claim 11, further comprising:

a strap channel extending through said strap wrench attachment head, a medial portion of said strap being positionable in said strap channel; and a strap pressure lock assembly coupled to said strap wrench attachment head, said strap pressure lock assembly including a pivotable friction member having an end extending into said strap channel and selectively engaging said strap, said strap pressure lock assembly including a biasing member for urging said friction member into engagement with said strap.

13. The assembly of claim 12, further including said strap pressure lock assembly being positioned in a cutout in said strap wrench attachment head.

14. The assembly of claim 12, further including an angled indentation into a side of said strap wrench attachment head, said indentation being positioned proximate said strap end aperture.

15. The assembly of claim 1, further comprising:

said plurality of attachment heads including a socket attachment head;

a polygonal hole extending through said socket attachment head; and a socket connector having a base and a first end opposite said base, said socket connector being insertable through said polygonal hole whereby said first end of said socket connector extends from said socket attachment head, said first end being configured for coupling to a socket.

16. The assembly of claim 1, further comprising:

said plurality of attachment heads including a pipe wrench attachment head;

an arm extendably coupled to said pipe wrench attachment head;

a static jaw plate coupled to said pipe wrench attachment head;

an adjustable jaw plate coupled to said arm, said adjustable jaw plate being positioned in opposition to said static jaw plate; and an adjustment assembly operationally coupled to said pipe wrench attachment head and said arm whereby said arm is extendable to adjust a distance between said adjustable jaw plate and said static jaw plate.

17. The assembly of claim 1, further including a tubular grip sleeve, said gripping section of said handle being insertable into said grip sleeve whereby said grip sleeve is coupled to said gripping section of said handle.

18. An interchangeable head wrench assembly comprising:

a handle having an elongated gripping section and a head engagement section coupled to and extending from said gripping section, an aperture extending through said head engagement section, said aperture extending through said head engagement section of said handle being polygonal, said aperture extending through said head engagement section of said handle being rectangular;

a plurality of interchangeable attachment heads, each attachment head having a seat portion, said seat portion having a perimeter edge complimentary to said aperture extending through said head engagement section of said handle such that said seat portion is insertable into said aperture whereby said attachment head is restricted from twisting within said aperture, each said attachment head having a lip extending outwardly around said seat portion, said plurality of attachment heads including a yoke engagement head, said plurality of attachment heads including a bar insert attachment head, said plurality of attachment heads including a chain wrench attachment head, said chain wrench attachment head having a chain attachment socket, said plurality of attachment heads including a strap wrench attachment head, said strap wrench attachment head having a strap attachment socket, said plurality of attachment heads including a socket attachment head, said plurality of attachment heads including a pipe wrench attachment head;

a plurality of holes extending through said head engagement portion proximate said aperture;

a plurality of openings extending through said lip of each said attachment head, said openings being aligned with said holes when said seat portion is inserted into said aperture;

an interior wall of said yoke attachment head extending through said seat portion, said interior wall being configured for receiving and engaging a yoke whereby holding said handle in a static position prevents rotation of the yoke;

a liner insert coupleable to said yoke engagement head, said liner insert having a pair of spaced panels and a medial wall extending between said spaced panels, said medial wall being configured for positioning between said interior wall of said yoke attachment head and the yoke, said spaced panels being parallel to each other and extending outwardly from said medial wall whereby peripheral portions of said spaced panels cover an outer face of said yoke attachment head and an outer face of said head engagement section of said handle;

a central portion of said bar insert attachment head being coupled to and extending from said seat portion, said bar insert attachment head having a receiving portion coupled to said central portion, said receiving portion having an elongated passage extending through said receiving portion, said passage being oriented parallel to said gripping portion of said handle when said bar insert attachment head is coupled to said handle;

a sleeve insertable into said passage of said bar insert attachment head, said sleeve having a channel extending therethrough configured for receiving an elongated member whereby manipulation of said handle acts on the elongated member;

a chain end aperture extending through said chain wrench attachment head into said chain attachment socket;

a chain having a first end and a second end;

a connection member coupled to said first end of said chain, said connection member being insertable into said chain attachment socket, said connection member having a connection hole, said connection hole aligning with said chain end aperture when said connection member is inserted into said chain connection socket;

a chain end pin inserted through said chain connection aperture engaging said connection hole whereby said first end of said chain is coupled to said chain wrench attachment head;

a chain channel extending through said chain wrench attachment head, a medial portion of said chain being positionable in said chain channel;

a chain link aperture extending through said chain wrench attachment head into said chain channel;

a chain link pin inserted through said chain link aperture into said chain channel engaging a link of said chain whereby said chain is held in a static position in said chain channel;

a hook coupled to and extending from said chain wrench attachment head, said hook engaging a link of said chain;

an angled indentation into a side of said chain wrench attachment head, said indentation being positioned proximate said chain end aperture;

a strap end aperture extending through said strap wrench attachment head into said strap attachment socket;

a strap having a first end and a second end;

a loop coupled to said first end of said strap, said loop being insertable into said strap attachment socket, said loop aligning with said strap end aperture when said loop is inserted into said strap connection socket;

a strap end pin inserted through said strap end aperture engaging said loop whereby said first end of said strap is coupled to said strap wrench attachment head;

a strap channel extending through said strap wrench attachment head, a medial portion of said strap being positionable in said strap channel;

a strap pressure lock assembly coupled to said strap wrench attachment head, said strap pressure lock assembly including a pivotable friction member having an end extending into said strap channel and selectively engaging said strap, said strap pressure lock assembly including a biasing member for urging said friction member into engagement with said strap, said strap pressure lock assembly being positioned in a cutout in said strap wrench attachment head;

an angled indentation into a side of said strap wrench attachment head, said indentation being positioned proximate said strap end aperture;

a polygonal hole extending through said socket attachment head;

a socket connector having a base and a first end opposite said base, said socket connector being insertable through said polygonal hole whereby said first end of said socket connector extends from said socket attachment head, said first end being configured for coupling to a socket;

an arm extendably coupled to said pipe wrench attachment head;

a static jaw plate coupled to said pipe wrench attachment head;

an adjustable jaw plate coupled to said arm, said adjustable jaw plate being positioned in opposition to said static jaw plate;

an adjustment assembly operationally coupled to said pipe wrench attachment head and said arm whereby said arm is extendable to adjust a distance between said adjustable jaw plate and said static jaw plate; and a tubular grip sleeve, said gripping section of said handle being insertable into said grip sleeve whereby said grip sleeve is coupled to said gripping section of said handle.

* * * * *